US005572899A

United States Patent [19]

Balaity et al.

[11] Patent Number: 5,572,899

[45] Date of Patent: Nov. 12, 1996

[54] BENDING METHOD USING COOPERATING JAWS HAVING ANGLED PLANAR FACES

[75] Inventors: Andrew Balaity, Wayne; Rocco R. Borzone, Emerson, both of N.J.

[73] Assignee: Howmedica Inc., New York, N.Y.

[21] Appl. No.: 287,456

[22] Filed: Aug. 8, 1994

[51] Int. Cl.[6] ..... B21D 37/10

[52] U.S. Cl. ..... 72/413; 72/415

[58] Field of Search ..... 72/413–416, 385, 72/389, 409, 481

[56] References Cited

U.S. PATENT DOCUMENTS

| | | | |
|---|---|---|---|
| 1,013,871 | 1/1912 | Ellis | 72/414 |
| 1,521,265 | 12/1924 | Anderson | 72/481 |
| 1,728,631 | 9/1929 | Sandoz | 72/409 |
| 2,421,457 | 6/1947 | Lindsay | 72/414 |
| 4,008,591 | 2/1977 | Vos | 72/385 |
| 4,891,965 | 1/1990 | Piacentini | 72/481 |

FOREIGN PATENT DOCUMENTS

| | | | |
|---|---|---|---|
| 440613 | 2/1927 | Germany | 72/416 |
| 33136 | 4/1981 | Japan | 72/385 |
| 871983 | 10/1981 | U.S.S.R. | 72/416 |

*Primary Examiner*—Daniel C. Crane

*Attorney, Agent, or Firm*—Peter C. Richardson; Lawrence C. Akers; Elizabeth O. Slade

[57] ABSTRACT

A device for bending a plate with an offset distance L and two angles simultaneously is provided, the device comprising special jaws which are replaceably attachable to the jaws of a pliers. A kit of a plurality of sets of bending jaws having a variety of offset lengths is provided.

6 Claims, 4 Drawing Sheets

BENDING METHOD USING COOPERATING JAWS HAVING ANGLED PLANAR FACES

BACKGROUND OF THE INVENTION

This invention relates generally to instruments for bending sheets of material and relates in particular to a device for bending sheets of metal for use, for example, in orthopedic applications (including but not limited to repair of maxillofacial fractures).

DESCRIPTION OF THE PRIOR ART

In the prior art, there has been a need for bent metal plates for use in repairing fractures, for example facial fractures. Such repairs of facial fractures can be accomplished by use of so-called Luhr plates, which are manufactured by Howmedica Inc.

In bending such plates, it has been known to bend the plates to fit the particular facial fracture, with one bend being made, followed by a second bend so as to fit the facial dimensions of the patient.

However, an improvement was sought for bending such plates which would have improved accuracy and reduction of the time for this bending procedure.

An object of this invention is a device for bending metal plates for use in orthopedics which will save time, compared with the bending procedure used in the prior art.

Another object of this invention is a bending device which will satisfy the two purposes of bending to the desired shape and of sizing (i.e., measuring the size of offset length required).

Yet another object of this invention is a device which will more quickly accurately, and dependably, bend metal plates than has been available in the prior art.

Another object of this invention is a method for bending metal plates which saves time and which is more accurate than methods that have been available in the prior art.

Yet another object of this invention is a set or a kit of a plurality of parts which are removably attachable to a set of pliers, so as to provide an adjustable device for bending metal plates with a variety of sizes of offsets of the metal.

These and other objects are satisfied by the device of the invention which comprises in a preferred embodiment, two removable bending jaws, one jaw to be attached to one jaw of a pliers and the second jaw to be attached to a second jaw of the pliers. Each of the bending jaws comprises (a) a first face adapted to engage and to be fixed to a first jaw of a pliers; (b) a second face spaced apart from the first face and having an offset surface bounded by two angles such that when a metal plate is placed between the two bending jaws positioned in a mating position, the metal plate is simultaneously bent at two positions at a first angle $\alpha$ and a second angle $\beta$ separated by the offset length L.

Also according to the invention, in a preferred embodiment, the bending jaws are substantially identical, and angle $\alpha$ and angle $\beta$ are both 90°.

In yet another preferred embodiment, the bending jaws are attached to the pliers by an attaching means, which in one embodiment is preferably a spring detent and in another embodiment is preferably a pin.

Further, according to the invention, a kit of a plurality of sets of two identical bending jaws with offsets equal to a plurality of lengths L, each set being attachable to a set of pliers is provided. In a preferred embodiment, the distances are of 1 millimeter increments, so as to provide, for example, a kit of bending jaws for use in bending a plurality of metal plates of different offset lengths, with a preferred kit comprising ten sets of two identical bending jaws with offsets equal to 2, 3, . . . . 11 mm.

DESCRIPTION OF THE PREFERRED EMBODIMENTS

DETAILED DESCRIPTION OF THE DRAWING

Figure 1:
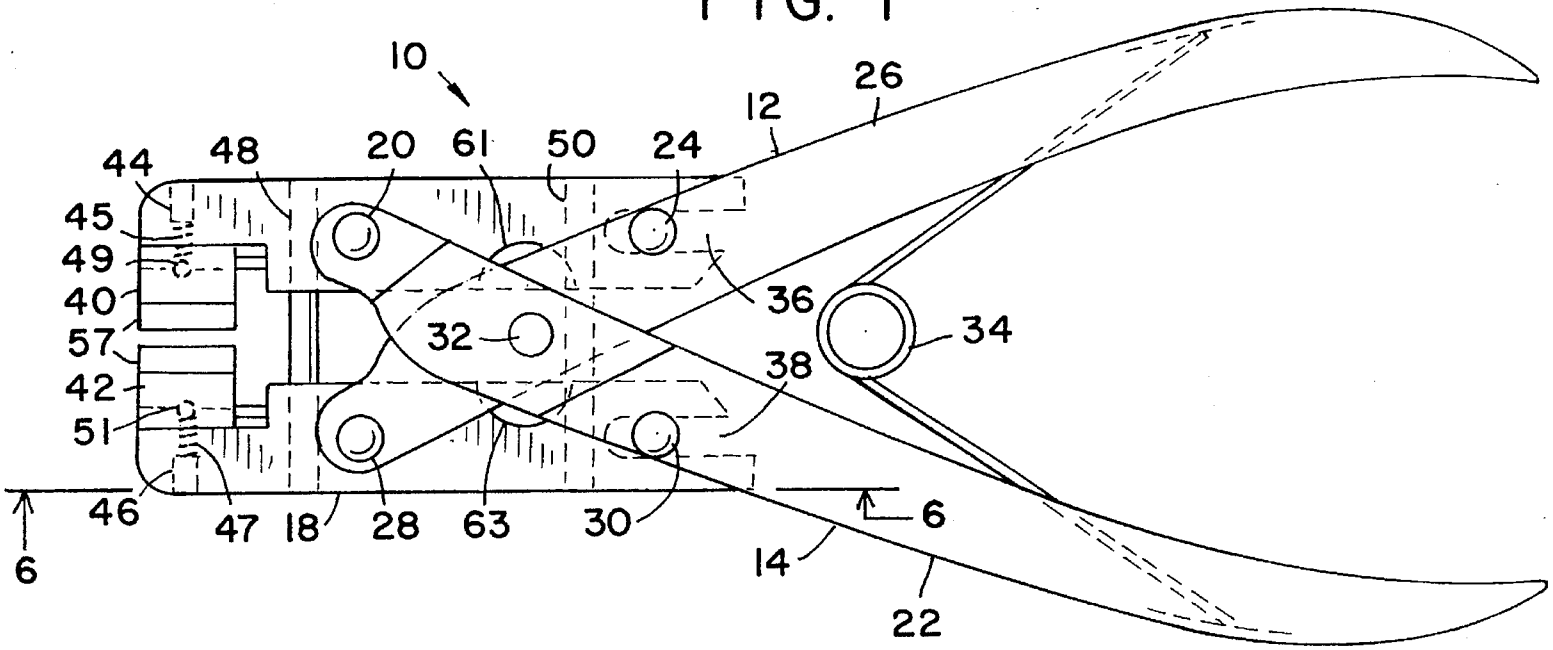
In FIG. 1, a side view (with phantom lines showing parts obscured from view) of a preferred embodiment of a bending instrument according to the invention is shown with its jaws in their open position, showing a set of two substantially identical bending jaws attached to a pliers.

Referring to the drawing, in FIG. 1, a side view of an embodiment of the bending instrument 10 of the invention is shown. That embodiment comprises, in one aspect, pliers 12 comprising a basic handle portion 14 (with a second pliers handle 22 and a first pliers handle 26) and a first pliers jaw 16 and a second pliers jaw 18. The first pliers jaw 16 is pivotally connected at first pin 20 to second pliers handle 22 and is slidably connected at second pin 24 to first pliers handle 26. Likewise, second pliers jaw 18 is pivotally connected at third pin 28 to first pliers handle 26 and is also simultaneously slidably connected at fourth pin 30 to second pliers handle 22. First pliers handle 26 and second pliers handle 22 are pivotally connected together at rivets 32 and 33. Spring 34 serves to force first pliers handle 26 and second pliers handle 22 apart and to force first pliers jaw 16 and second pliers jaw 18 together in the rest position of spring 34 when it is in its uncompressed state. Second pin 24 can slide within slot 36 of first pliers jaw 16, and fourth pin 30 can slide within slot 38 of second pliers jaw 18.

Also shown in FIG. 1 are first bending jaw 40 and second bending jaw 42, which in this preferred embodiment are a matching pair of substantially identical bending jaws positioned and held in place on first pliers jaw 16 and second pliers jaw 18, respectively, by means of screw 44 and screw 46 which are used to secure springs 45 and 47 and balls 49 and 51 in jaws 16 and 18, respectively. The balls 49 and 51 are used to bear against the holes 76 and 78 in jaws 40 and 42 to keep jaws 40 and 42 in place on the pliers jaws 16 and 18, respectively. See also FIGS. 4A and 4B, described below.

Also shown in FIG. 1 in phantom lines is first elongated pin 48 and second elongated pin 50, which serve to stabilize jaws 16 and 18 to assure parallel movement of the jaws 16 and 18.

Figure 2:
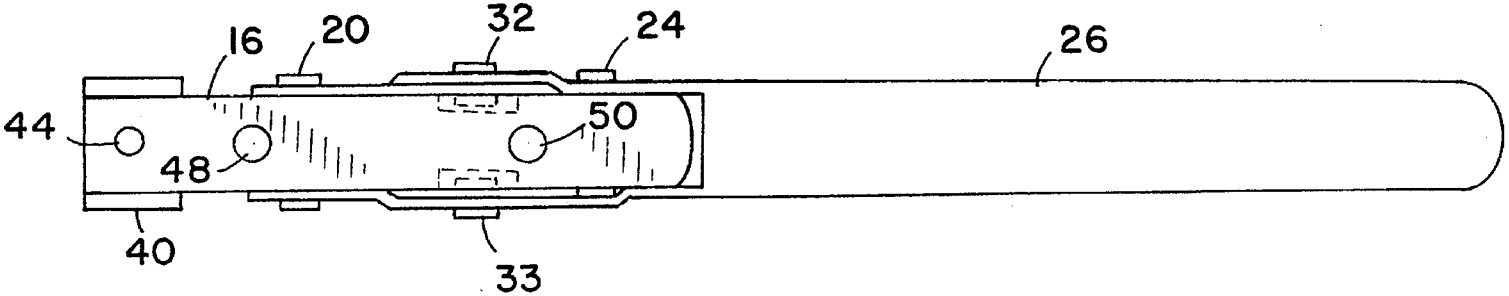
FIG. 2 is a top view of the device of FIG. 1.

FIG. 2 is a top view of the embodiment of the device of the invention shown in FIG. 1, with corresponding parts labeled correspondingly.

Figure 3:
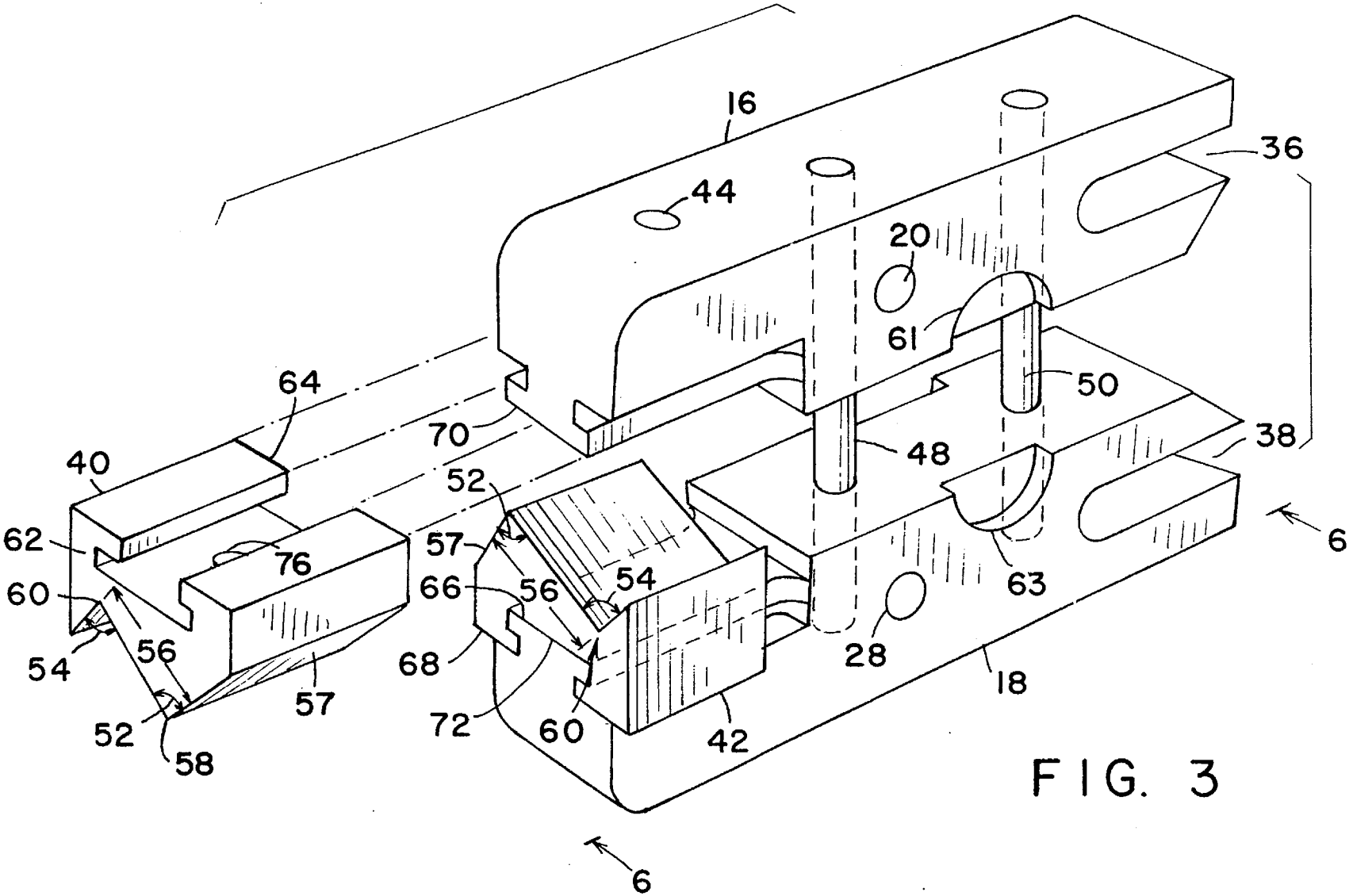
FIG. 3 is a plan view of the part of the device shown in FIG. 1 which is to be connected as shown in FIG. 1 to the two basic pliers handles, showing an exploded view of one bending jaw separated from one pliers jaw and a matching bending jaw attached to the other pliers jaw.

In FIG. 3, first bending jaw 40 is shown in an exploded view separated from first pliers jaw 16, whereas second bending jaw 42 is shown in its position attached to second pliers jaw 18 (attached by means of pin 46, shown in FIG. 1 but not in FIG. 3).

First bending jaw 40 and second bending jaw 42 both have the same first angle 52 and the same second angle 54, which are substantially equal. Additionally, both first bending jaw 40 and second bending jaw 42 have the same offset length L 56, which is the distance between the vertex 58 of first angle 52 and the vertex 60 of second angle 54.

First bending jaw 40 has a slot (or groove or keyway) 62 located within its planar face 64, the planar face 64 being spaced apart from the offset length L 56 (which is angled with respect to planar face 64); and second bending jaw 42 has a slot (or groove or keyway) 66 located within its planar face 68, the planar face 68 being spaced apart from the plane in which offset 56 in second bending jaw 42 is located. Slot 62 in first bending jaw 40 is shaped slightly larger than but is substantially identical to the mating shape 70 of first pliers jaw 16; and, likewise, slot 66 in second bending jaw 42 is shaped substantially identical to the shape of mating shape 72 in second pliers jaw 18. In a preferred embodiment, first mating shape 70 and second mating shape 72 are T-shaped and are an integral part of first pliers jaw 16 and second pliers jaw 18, respectively.

Figure 4A:
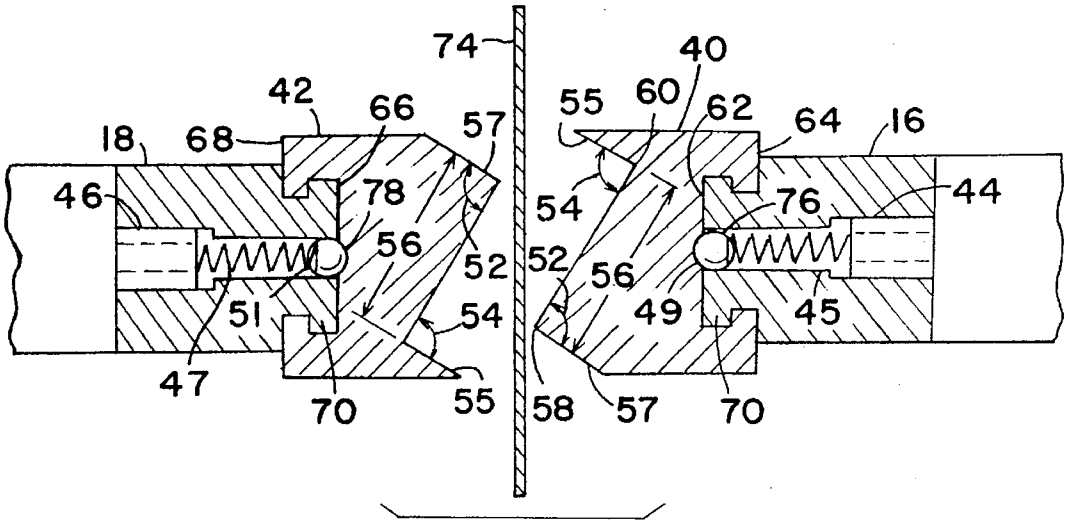
In FIG. 4A, a sheet of metal is shown located between a set of two matching bending jaws which are in their open position, each of the two substantially identical matching bending jaws connected to a different pliers jaw and held in place by the friction produced by the spring-actuated pressure of a ball, prior to the event of the bending of the metal sheet.

In FIG. 4A, unbent metal sheet 74 is shown positioned between first bending jaw 40 and second bending jaw 42 when those two bending jaw are in their open position. First bending jaw 40 is connected to first pliers jaw 16 by means of first jaw screw 44, which bears against a compression spring 45 which bears against a ball 49 which bears against the hole 76 with sufficient friction to prevent disassociation of the jaw 40 from the pliers jaw 16.

Figure 4B:
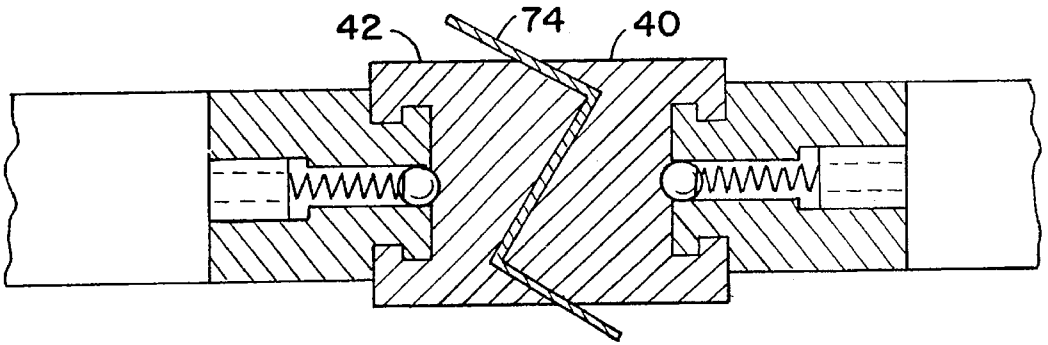
In FIG. 4B, the items shown in FIG. 4A are shown in the closed position of the two substantially identical matching bending jaws, during the event of the bending of the metal sheet, in which the metal sheet assumes simultaneously a shape having two substantially identical angles separated by an offset length, the bent shape being achieved by one stroke of the bending pliers according to the invention.

In FIG. 4B, the same items shown in FIG. 4A are shown, but with the mating first bending jaw 40 and second bending jaw 42 being shown in the closed position such that the metal sheet is bent at two places simultaneously with the same bent angle.

Figure 5:
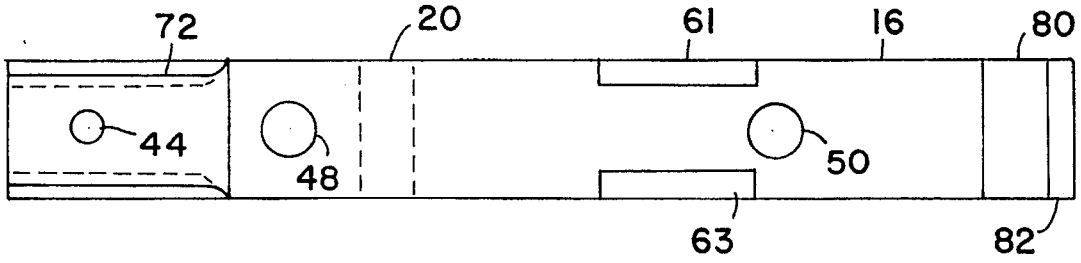
FIG. 5 is a top view of a part of the device shown in FIG. 2.

FIG. 5 is a view from above of the first pliers jaw 16 shown in FIGS. 1 and 3, without having attached thereto first bending jaw 40. FIG. 5 is also a top view of a part of the device shown in FIG. 2.

Figure 6:
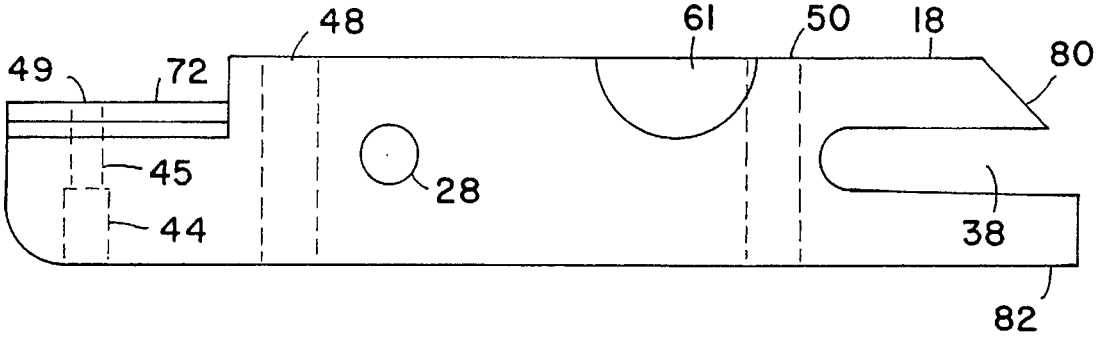
FIG. 6 is a side view of the lower pliers jaw as shown in FIG. 3 (but without the bending jaw attached and with the pliers jaw rotated through 90°).

FIG. 6 is a side view taken along the line 6—6 in FIG. 3 of second pliers jaw 18, which also is shown in FIG. 1 and taken along the line 6—6 in FIG. 1. Corresponding parts are labeled correspondingly. Grooves 61 and 63 are required to prevent the jaws from hitting rivets 32 and 33, respectively.

Figure 7A:
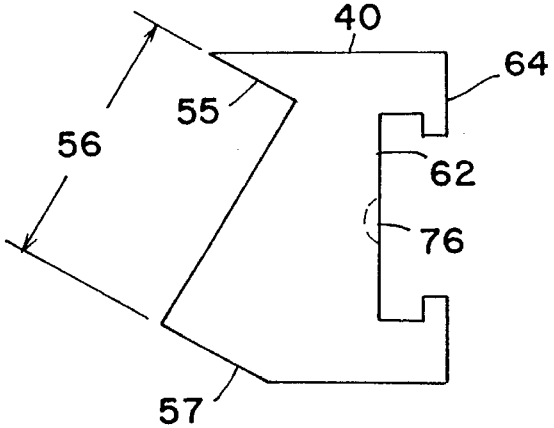
FIGS. 7A and 7B are side views of an embodiment of two bending jaws of the invention (as are shown in FIGS. 3 and 4, but having two different offset lengths.)
Figure 7B:
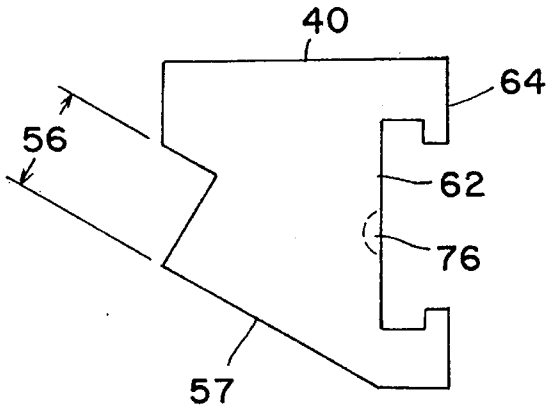

FIG. 7A and 7B are side views of first bending jaw 40 (and also of second bending jaw 42) but having offset lengths L 56 of two different lengths.

Figure 8A:
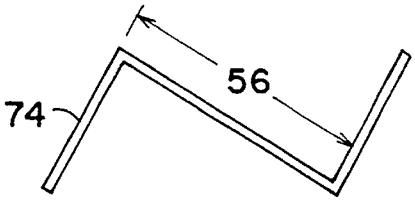
FIGS. 8A and 8B show the correspondingly sized bends which are formed by two bending jaws as in FIG. 7A and two bending jaws as in FIG. 7B, respectively.
Figure 8B:
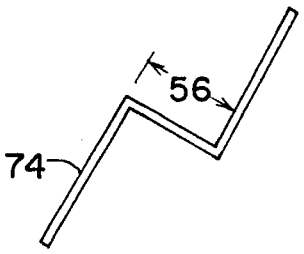

FIGS. 8A and 8B are cross-sectional views of metal plate 74 (viewed in cross-section) showing how it would be bent when two substantially identical bending jaws as shown in FIG. 7A are used according to the invention and when two substantially identical bending jaws as shown in FIG. 7B are used, respectively, showing two differently sized offsets 56 (as are shown in FIG. 7A and 7B, respectively).

FIGS. 8A and 8B show in cross-section two metal sheets which were each bent by using together two substantially identical bending jaws as shown in FIGS. 7A and 7B, respectively.

Figure 9:
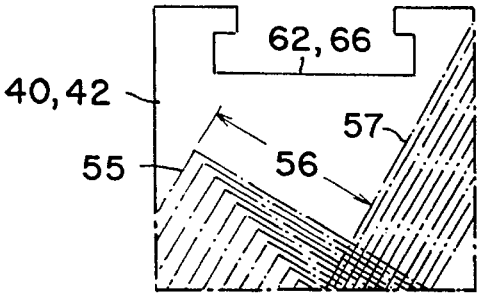
FIG. 9 is a side view of a block of metal showing how from that one block of metal one of eleven different bending jaws according to the invention can be cut, each with an offset separated by two bending angles (which in a preferred embodiment are substantially identical angles and are right angles).

FIG. 9 is a side view depicting how a single block of metal with eleven different offsets are cut from that same piece of metal so as to form eleven different bending jaws, each having two substantially identical bending angles which are separated by an offset length which is different for each of the eleven different bending jaws. The preferred T-shaped slot (or groove or keyway 62, 66) is also shown in the bending jaw 40, 42.

The offset distance 56 in the bending jaws of the invention can be chosen as desired. However, for use in bending plates of metal for use on facial fractures, preferably the offset distance will be chosen for an individual bending jaw from within the range from 2 to 11 millimeters. Most preferably, sets of the bending jaws will be formed in sets of 10, with offset increments of 1 millimeter and will be 2, 3 . . . . 11 millimeters.

Preferably first bending jaw 40 and second bending jaw 42 will be attached to first pliers jaw 16 and second pliers jaw 18, respectively as described above. However, any other suitable means of attachment can be used.

Preferably, first angle 52 and second angle 54 will be both right angles (i.e., 90°). However, if desired, the angles can be other than 90° and can be unequal angles.

The spring of pliers 10 keeps the jaws in an open position when the spring is not compressed.

Preferably the slot (or groove or keyway) 62 in first bending jaw 40 and the slot 66 in second bending jaw 42 are T-shaped so that the bending jaw can be slid onto the corresponding pliers jaw.

By use of the pins 20, 24, 28, and 30, the jaws of the pliers in a preferred embodiment move in a parallel manner (that is, the jaw faces remain parallel to each other when the handles 22, 26 are squeezed).

Suitable pliers which are commercially available for use with the first bending jaw 40 and second bending jaw 42 of the invention are available from Aesculap.

The advantages of the bending instrument of the invention include the following. The device saves time in bending metal plates. Smaller inventories of bending jaws and of bent plates are required because the bent plates can be produced as needed. The bending jaws can serve as gauges when templates are used to establish the offset distance which is required, and then the plates can be bent with the appropriate pair of bending jaws.

We claim:

1. A method for accurately and quickly repairing a facial fracture on a patient having particular facial dimensions, said method comprising:

(a) measuring with a template an offset length L required to fit and correct said facial fracture;

(b) selecting a bending jaw from a set of bending jaws having offset increments of 1 millimeter and offset lengths L between 2 millimeters and 11 millimeters; and (c) bending a facial bone plate simultaneously at two positions separated by said offset length L, said method of bending comprising:

(A) inserting said plate of metal into a plate bender comprising:

(a) a first replaceable bending jaw attached to a first pliers jaw, said first replaceable jaw comprising:

(1) a first planar face having a groove therein which engages a corresponding protrusion of said first pliers jaw and;

(2) a second planar face spaced apart from said first planar face and angled with respect to said first planar face and having a cross-section having an offset length L which is bounded both by a first plane and a second plane spaced at an angle $\alpha_1$ and $\alpha_2$ with respect to each other; and (b) a second replaceable jaw attached to a second pliers jaw, said second replaceable jaw comprising:

(1) a third planar face having a groove therein which engages a corresponding protrusion of said second pliers jaw and;

(2) a fourth face spaced apart from said third face and angled with respect to said third face and having a cross-section having an offset length L which is bounded by both a third plane and a fourth plane spaced at an angle $\alpha_3$ and $\alpha_4$ with respect to each other, and (B) pressing said first bending jaw and said second bending jaw together with said metal sheet therebetween, so as to bend said metal sheet simultaneously with two angles spaced apart by said offset length L.

2. A method according to claim 1 wherein said second replaceable jaw is substantially identical to said first replaceable jaw.

3. A method according to claim 2 wherein said plate bender includes also said-first pliers jaw and said second pliers jaw.

4. A method according to claim 3 wherein said plate bender includes also a first spring loaded ball for attaching said first bending jaw to said first pliers jaw and a second spring loaded ball for attaching said second bending jaw to said second pliers jaw.

5. A method according to claim 4 wherein said angle $\alpha_1$ and said angle $\alpha_2$ are equal and wherein said angle $\alpha_3$ and said angle $\alpha_4$ are equal.

6. A method according to claim 5 wherein said angle $\alpha_1$, said angle $\alpha_2$, said angle $\alpha_3$ and said angle $\alpha_4$ are all 90°.

* * * * *